US009709369B2

(12) United States Patent
Ramí Porté et al.

(10) Patent No.: US 9,709,369 B2
(45) Date of Patent: Jul. 18, 2017

(54) DISARMING SYSTEM AND METHOD FOR DISARMING AMMUNITION CARTRIDGES

(71) Applicant: MAXAMCORP HOLDING, S.L., Madrid (ES)

(72) Inventors: Sergio Ramí Porté, Catillazuelo-Huesca (ES); Miguel Cans Vázquez, Catillazuelo-Huesca (ES)

(73) Assignee: MAXAMCORP HOLDING, S.L., Madrid (ES)

( * ) Notice: Subject to any disclaimer, the term of this patent is extended or adjusted under 35 U.S.C. 154(b) by 0 days.

(21) Appl. No.: 14/786,775

(22) PCT Filed: Apr. 23, 2014

(86) PCT No.: PCT/EP2014/058259
§ 371 (c)(1),
(2) Date: Oct. 23, 2015

(87) PCT Pub. No.: WO2014/173964
PCT Pub. Date: Oct. 30, 2014

(65) Prior Publication Data

US 2016/0076865 A1 Mar. 17, 2016

(30) Foreign Application Priority Data

Apr. 24, 2013 (EP) ..... 13382150

(51) Int. Cl.
*F42B 33/06* (2006.01)

(52) U.S. Cl.
CPC ..... *F42B 33/06* (2013.01)

(58) Field of Classification Search
CPC ..... F42B 33/06
USPC ..... 86/49
See application file for complete search history.

(56) References Cited

U.S. PATENT DOCUMENTS 2,349,248 A 5/1944 Costello
3,056,191 A * 10/1962 Felmet ..... B21D 28/34 279/53
3,174,389 A * 3/1965 Davis ..... F42B 33/06 86/23
4,005,630 A * 2/1977 Patrick ..... F42B 33/06 279/51

(Continued)

FOREIGN PATENT DOCUMENTS

DE 78715 C 12/1894
DE 2856436 A1 7/1989

(Continued)

OTHER PUBLICATIONS

International Search Report, Jul. 21, 2014.

*Primary Examiner* — Bret Hayes
(74) *Attorney, Agent, or Firm* — Tristan A. Fuierer; Moore & Van Allen, PLLC

(57) ABSTRACT

A dismantling system (5) for separating ammunition cartridges (10) comprising a casing (12), a bullet (11) and powder among its components, the system being characterized in that it comprises an extraction head (53) for extracting the bullet (11) from the casing (12), and retaining elements (52) for retaining the casing (12) in an extraction position while extracting the bullet (11). The invention also comprises a disarming system and a method for separating the components of an ammunition cartridge (10).

12 Claims, 6 Drawing Sheets

(56) References Cited

U.S. PATENT DOCUMENTS

| | | | | |
|---|---|---|---|---|
| 4,028,989 | A * | 6/1977 | Vassallo | F42B 33/06 81/3.05 |
| 7,568,417 | B1 * | 8/2009 | Lee | F42B 33/06 86/49 |
| 2005/0109199 | A1 * | 5/2005 | Chamlee | F42B 33/062 86/49 |

FOREIGN PATENT DOCUMENTS

| | | | |
|---|---|---|---|
| GB | 627268 | A | 8/1949 |
| WO | 2011059357 | A1 | 5/2011 |

* cited by examiner

DISARMING SYSTEM AND METHOD FOR DISARMING AMMUNITION CARTRIDGES

CROSS-REFERENCE TO RELATED APPLICATIONS

This application is filed under the provisions of 35 U.S.C. §371 and claims the priority of International Patent Application No. PCT/EP2014/058259 filed on 23 Apr. 2014 entitled "DISARMING SYSTEM AND METHOD FOR DISARMING AMMUNITION CARTRIDGES" in the name of Sergio RAMÍ PORTÉ, et al., which claims priority to European Patent Application No. 13382150.4 filed on 23 Apr. 2013, both of which are hereby incorporated by reference herein in their entirety.

OBJECT OF THE INVENTION

The object of the invention is comprised in the field of disarming ammunition cartridges and relates to a method and system which allows separating an ammunition cartridge into its different components in order to reuse them.

BACKGROUND OF THE INVENTION

Ammunition disarming processes are somewhat known in the armament sector. On one hand it is convenient to recover the powder from unused elements, and on the other hand it is convenient to render other potentially hazardous elements inert.

A known manner of disposing of obsolete ammunition is to introduce it in furnaces while still armed, which requires a sizeable power consumption and results in a large amount of gases that have to be filtered and processed to reduce emissions which, even after that, are still quite considerable. This noticeably affects demilitarization costs and the economic return on the recovered/recycled materials.

To date, there is still no machine that integrally and automatically performs all the tasks of disarming ammunition cartridges in a relatively reduced space that can be easily moved in a truck and complying with all mandatory safety conditions of a task of such importance. Disarming processes in the current state of the art are performed manually or semi-automatically and are not usually complete, leaving parts to be done in furnaces. Examples comprised in the state of the art include mechanisms for extracting bullets from medium and large gauge projectiles (e.g. "Demil plant" of Konstrukta industry). The features of these mechanisms make it necessary to build infrastructures that cannot be moved once built, which makes it impossible to use them in those places where ammunition has been disposed of. Furthermore, they are mechanisms that allow only one type of ammunition, so it is not always compatible for any user.

The present invention does not require using a furnace for rendering the hazardous elements inert (non-detonated casings, etc.), saving energy and safety and pollutant emission problems. Also, with minimal involvement of the operator, consisting of feeding the inlet hopper with the cartridges, all the elements are automatically separated, only having to periodically emptying powder from the outlet hoppers. After each step of the disarming process, control elements verify that said step is carried out correctly so that potentially hazardous manipulations are not performed. The resulting materials are entirely recyclable and maintain their market value because their conditions are not altered by the incineration/detonation in the furnace (powder, lead, steel, brass).

DESCRIPTION OF THE INVENTION

In a first inventive aspect, the invention relates to a dismantling system for separating ammunition cartridges comprising a casing, a bullet and powder among their components. This system comprises an extraction head for extracting the bullet from the casing and retaining means for retaining the casing in an extraction position while extracting the bullet.

In a particular embodiment, the retaining means comprise an upper support suitable for resting on a widening of the cross section of the casing, preventing the casing from moving in the extraction direction of the bullet.

In a particular embodiment, the upper support is connected to motor means suitable for moving the upper support linearly in a direction to bring it closer to and further from the extraction position.

In a particular embodiment, the retaining means comprise at least one flange suitable for holding the casing by means of driving said flange in the base of the casing.

In a particular embodiment, the extraction head comprises at least two dogs suitable for being driven on the bullet of the cartridge and arranged in the extraction head for peripherally surrounding at least part of the bullet.

In a particular embodiment, each dog comprises a pivoting element, the pivoting element comprising a pivoting point on which it can rotate and at least one claw projecting from one end of the pivoting element and which is suitable for being driven on a bullet.

In a particular embodiment, the system additionally comprises a spring connected with the pivoting element of the dog such that a rotation of the pivoting element with respect to a position in which the dog and spring assembly is balanced has to overcome the recovery force exerted by the spring.

In a particular embodiment, the system comprises motor means suitable for moving the extraction head in a direction to bring it closer to and further from the extraction position of the casing.

In a second inventive aspect, the invention relates to a disarming system for disarming ammunition cartridges comprising a dismantling system according to the first inventive aspect.

In a particular embodiment, the disarming system comprises a plurality of circulating clamps and forward movement means of the circulating clamps. Each clamp is suitable for holding a cartridge. The forward movement means of the circulating clamps are suitable for moving the circulating clamps through the disarming system.

In a particular embodiment, the disarming system additionally comprises at least one of the following elements:

a striking system for detonating the primers of empty casings, a crushing system for crushing the struck casings, an ejection system for ejecting the casings, at least one verification element (not shown) which informs in the event that the envisaged operations have not been performed correctly in the dismantling system and/or in the ejection system, a plurality of outlet ramps for receiving the components individually, and a plurality of outlet hoppers for collecting the separated components.

In a particular embodiment, at least one of the elements of the disarming system is interchangeable for adapting its operation to different gauges of ammunition cartridges.

In a third inventive aspect, the invention relates to a method for separating the components of an ammunition cartridge using a dismantling system according to the first inventive aspect, characterized in that it comprises the following steps:

a) holding the casing of the cartridge using retaining means, b) extracting the bullet from the cartridge, and c) inverting the orientation of the cartridge, causing the explosive material to be emptied from its interior.

In a particular embodiment of the method, step b) for extracting the bullet from the cartridge comprises the following steps:

bringing a bullet extraction head closer to the cartridge, such that when the bullet penetrates said bullet extraction head it pushes dogs comprised in said bullet extraction head such that when pushed, said dogs latch onto the bullet of the cartridge, and moving the bullet extraction head away, such that the dogs pull the bullet out of the casing of the cartridge in that movement.

In a particular embodiment of the method, step a) for holding the casing of the cartridge using retaining means comprises the following steps:

bringing an upper support closer to the cartridge arranged with the tip of the bullet oriented towards said support, such that the support rests on a widening of the cross section of the casing, and/or holding the cartridge by the base of the casing by means of flanges.

All the features and/or the steps of methods described in this specification (including the claims, description and drawings) can be combined in any way except the combinations of such features that are mutually exclusive.

DESCRIPTION OF THE DRAWINGS

These and other features and advantages of the invention will become more clear from the following detailed description of a preferred embodiment given solely by way of illustrative and non-limiting example in reference to the attached drawings.

DETAILED DESCRIPTION OF THE INVENTION

Figure 1:
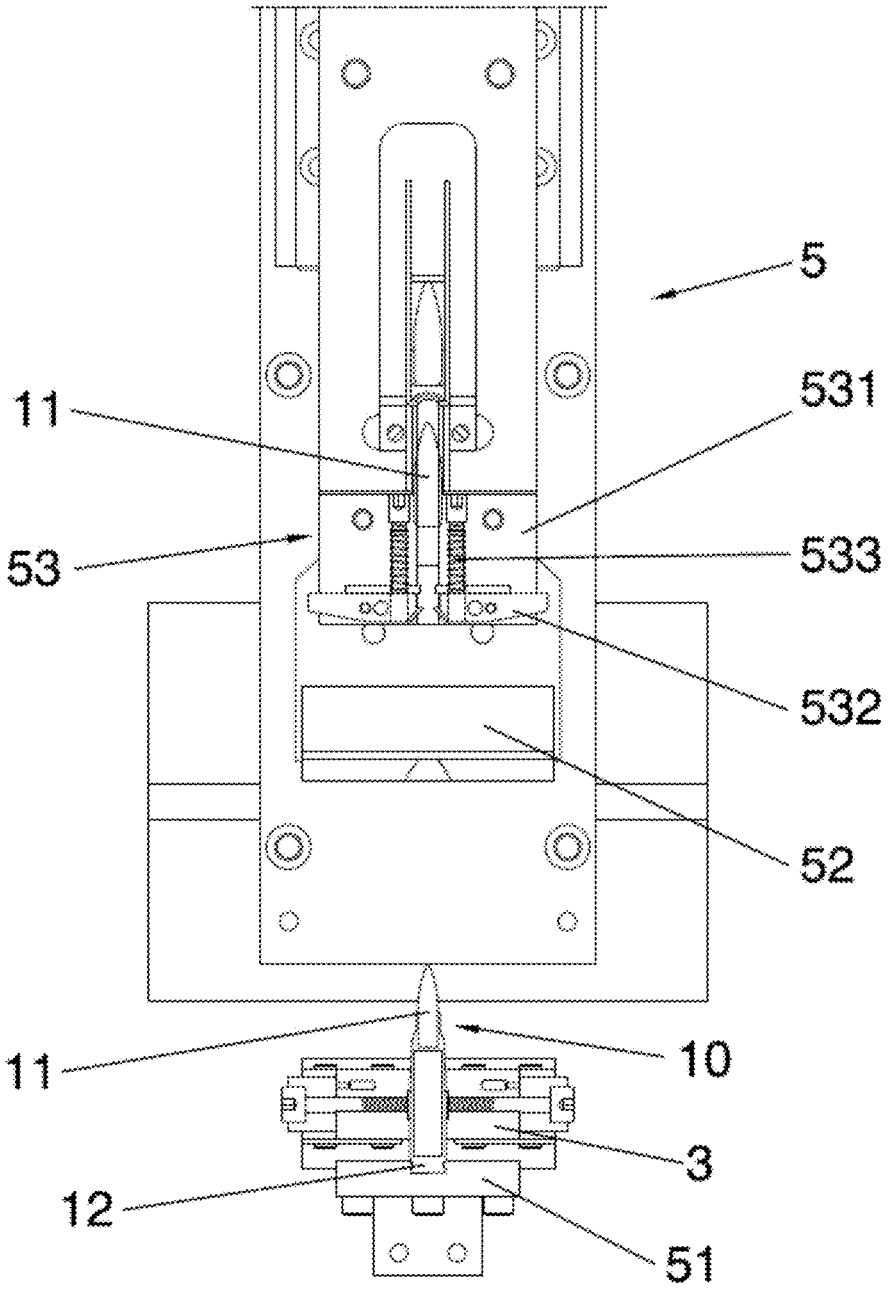
FIG. 1 shows a diagram of the dismantling system according to an embodiment of the invention.
Figures 2A, 2B, 2C, 2D:
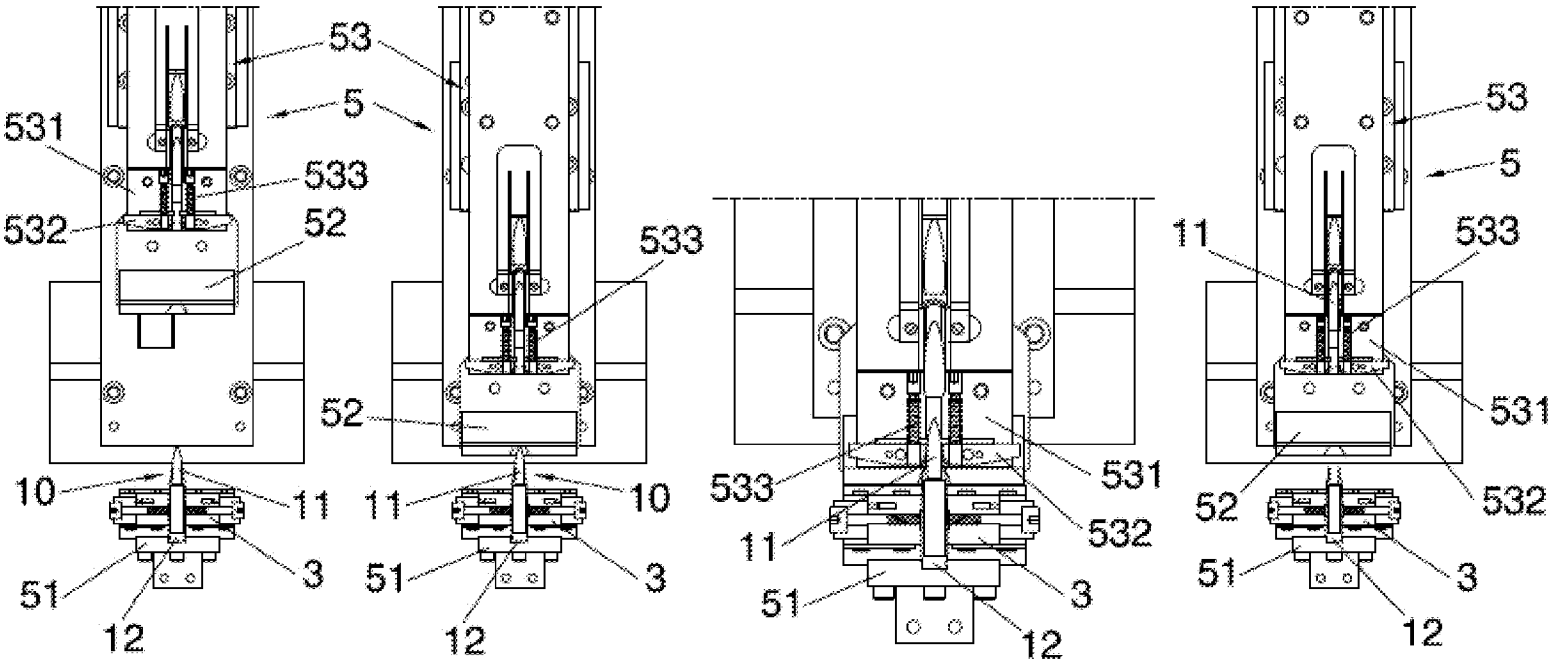
FIG. 2A-2D shows a diagram of the method for extracting a bullet.

The configuration of a dismantling system (5) according to the invention, suitable for separating the bullet (11) from the casing (12) of a cartridge (10) is observed in detail in FIG. 1. The dismantling system (5) of the invention comprises an extraction head (53) for extracting the bullet (11) from the casing (12) and retaining means for retaining the casing (12) in an extraction position while extracting the bullet (11).

In the embodiment exemplified in FIG. 1, the retaining means comprise an upper support (52) which uses a widening of the cross section of the casing (12) to prevent the casing (12) from moving in the extraction direction of the bullet (11), which would be the direction towards the upper part of the page in the figure. In this embodiment, the upper support (52) is a metal part comprising a through hole where the casing (12) enters, leaving the bullet (11) exposed and accessible for the bullet extraction head (53).

In the embodiment of the figure, the dismantling system furthermore has a casing seat (51), which forms a support to support the base of the casing (12) while the process of extracting the bullet (11) is being carried out.

In this embodiment, the bullet extraction head (53) comprises dogs (532) and springs (533). Each dog (532) can pivot with respect to one of its points, and each spring (533) is supported on the end of a dog (532), such that when the dog (532) rotates, it compresses the spring (533). There is also a stop that prevents the dogs (532) from freely rotating about their articulation point. In a particular embodiment, the dogs (532) are held in a support (531) with respect to which they pivot. In a particular embodiment, a pivoting part and a claw (not shown) projecting from one end of the pivoting element (not shown) and which is suitable for being driven on a bullet (11) are distinguished in the dog (532). In a particular embodiment, the dog (532) comprises more than one claw.

The operating principle of this system is based on the fact that the cartridge (10) is held and the bullet (11) is extracted in a single downwards and upwards movement of movable elements.

This movement whereby the casing (12) and the bullet (11) are separated can be observed in FIGS. 2A-2D.

In a particular embodiment, the cartridge (10) is located in the dismantling system located on the casing seat (51) and/or held by clamps (3) that could furthermore have been used to take the cartridge (10) to the dismantling system (5). In the extraction step, the upper support (52) moves downwards on the cartridge (10) while said cartridge (10) remains still. Said upper support (52) comprises a hole such that when the upper support (52) reaches its lower point, said hole fits over the casing (12).

Then the bullet extraction head (53) moves downwards. In the downward movement of the bullet extraction head (53), the dogs (532) come into contact with the bullet (11), which causes them to pivot against the recovery force of the spring. When the bullet extraction head (53) finishes moving downwards and starts to move upwards from the lower position, the upwards movement of the extraction head (53) causes the dogs (532) to be driven on the bullet (11). The actual shape of said bullet (11) prevents said dogs (533) from rotating in the opposite direction and becoming loose.

As the bullet extraction head (53) moves upwards, moving away from the casing (12) which is immobilized in the so-called extraction position, the dogs (532) that are driven on the bullet (11) pull on the bullet (11) and separate it from the casing (12). Once the bullet (11) has been separated, the upper support (52) starts to move upwards, thereby releasing the casing (12), which can be removed from the dismantling system by means of circulating clamps (3), for example.

The main advantage of this system is that the enormous force it can exert, which is necessary for extracting the bullet (11) from certain cartridges (10), is not transmitted to the clamps (3) holding the cartridges (10) or to other parts of the dismantling system (5) as a result of the holding of the retaining means. In other words, the extraction force is absorbed by the internal mechanisms of the dismantling system.

If the dismantling system (5) is envisaged for operating in a continuous process, when the bullet extraction head (53) and the upper support (52) are in the upper position, the cycle can start again with a new cartridge (10). Therefore, as the bullet extraction head (53) moves downwards again on a new cartridge, the new bullet (11) will push the bullet removed from the previous cartridge, pushing it through a conduit comprised in said bullet extraction head (53) towards an outlet to the exterior, for example, an outlet ramp (not shown) to a separated bullet outlet hopper.

The movement of the upper support (52) and of the bullet extraction head (53) is limited by vertical guides and caused by an eccentric connecting rod-wheel system. Even though the movement of the upper support (52) and of the extraction head (53) is operated by a single rotary mechanism, the movement is not completely simultaneous.

The operation of said rotary mechanism is carried out by means of an electrically-operated geared motor, the output shaft of which has a coupled flywheel (not shown) which in addition to serving as a momentum flywheel provides the necessary movements to the upper support (52) and to the bullet extraction head (53).

The movement of the bullet extraction head (53) is performed by means of a connecting rod eccentrically attached to the momentum flywheel, which provides it with an almost sinusoidal movement. The upper support (52), in turn, is moved by a cam follower (not shown) running through a groove of the momentum flywheel on its inner face, and which acts as counter rolling track. The groove of the flywheel (not shown) is machined such that when the extraction head is in the upper position, the support is as well.

The groove through which the cam follower that moves the support runs is precisely shaped so that the upper support moves such that it is in the lower position (the casing (12) resting on it), since before the extraction head comes into contact with the bullet (11), while the extraction takes place, and it does not start to move upwards until the head has already extracted the bullet (11) completely.

Both the upper support (52) and the bullet extraction head (53) are replaceable elements to enable adapting them to the different gauges of the cartridges (10). The dismantling system can therefore be used for any gauge, using an upper support (52) and a bullet extraction head (53) suitable for the gauge of the ammunition to be disarmed.

Only in the smallest gauges, 9 mm for example, where it is impossible to hold the casing (12) by means of the upper support (52) since it does not have a conical part, is the cartridge (10) held by the base of the casing (12) by means of flanges (not shown). These flanges are replaceable and can hold different gauges of cartridge (10) if their geometry requires it. Advantageously, even though both retaining systems, i.e., upper support (52) and flanges, can be used together to assure better fixing: while the upper supports (52) prevent force from outside the station from being transmitted, the flanges prevent the casing (12) from getting stuck in the upper support (52), thus preventing said upper support (52) from taking it upwards when it is subsequently raised.

Figure 3:
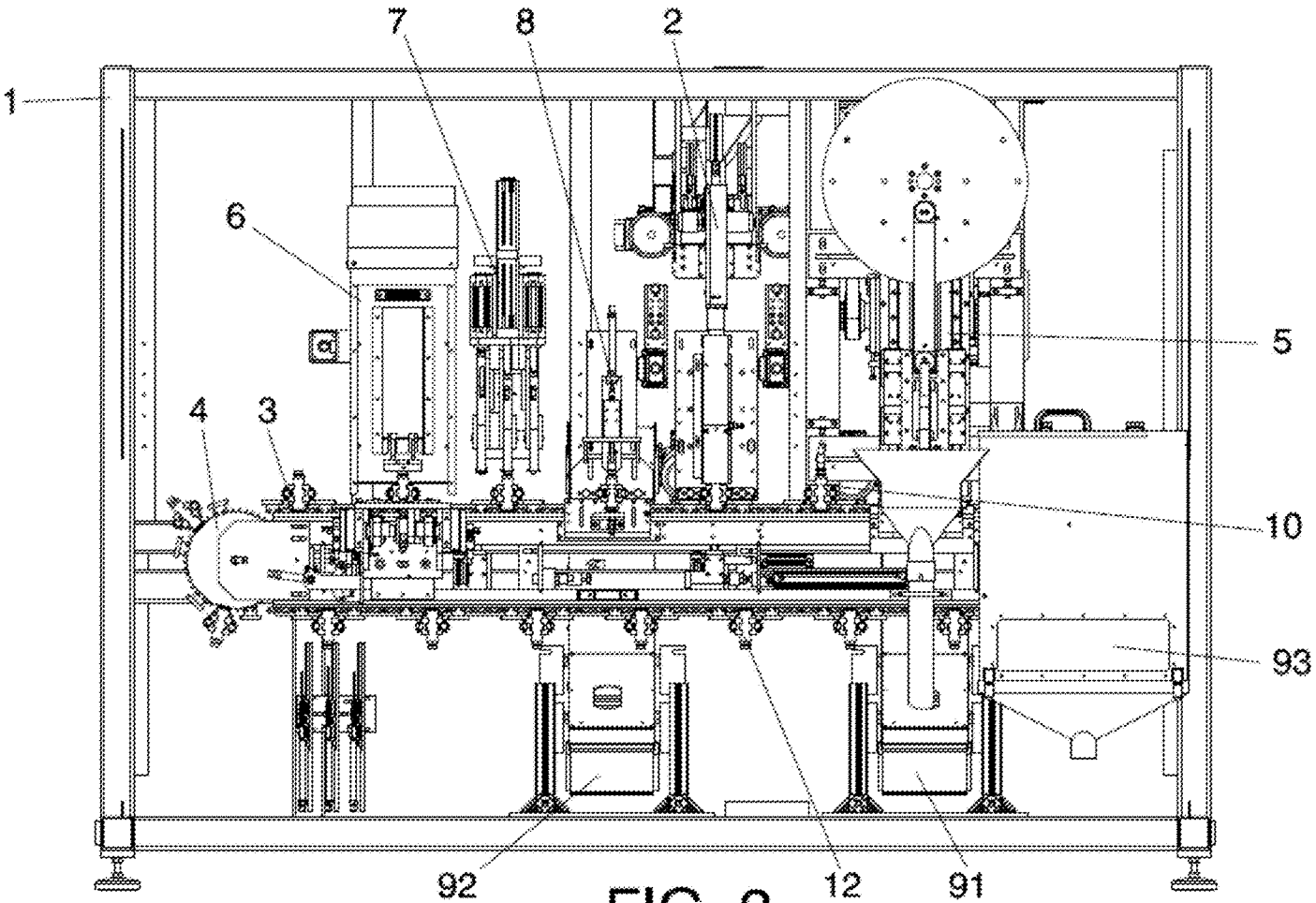
FIG. 3 shows a general diagram of a disarming system according to an embodiment of the invention.

A preferred embodiment of a disarming system according to the invention is observed in FIG. 3. The disarming system comprises, in addition to a dismantling system (5) according to the invention, one or several additional elements. The following elements are included in the embodiment shown:

- a cartridge intake system (2),
- a set of circulating clamps (3) for transferring the cartridges (10) through the disarming system,
- a striking system (6) for detonating the primers of empty casings (12),
- a crushing system (7) for crushing the struck casings (12),
- an ejection system (8) for ejecting crushed casings (12),
- an outlet ramp system for the separated and crushed casings (12), and
- several auxiliary elements, which collect the separated components:
  - a separated bullet outlet hopper (91),
  - an empty casing outlet hopper (92), and
  - an extracted powder collection hopper (93).

The aforementioned elements are preferably assembled in a main chassis (1).

The disarming system preferably includes control means for controlling the correct operation of the disarming system, checking that no error takes place and if one should take place, safely stopping the operation of the disarming system and reporting the occurrence of said error with the highest precision and highest level of information possible.

The disarming system can additionally include a display screen for showing information relating to the ammunition to be processed and to the operation of the entire disarming system and of its individual sub-systems, as well as for displaying errors and incidents that may eventually take place and notifying about maintenance tasks that have to be performed, depending on the number of cartridges processed.

Figure 4:
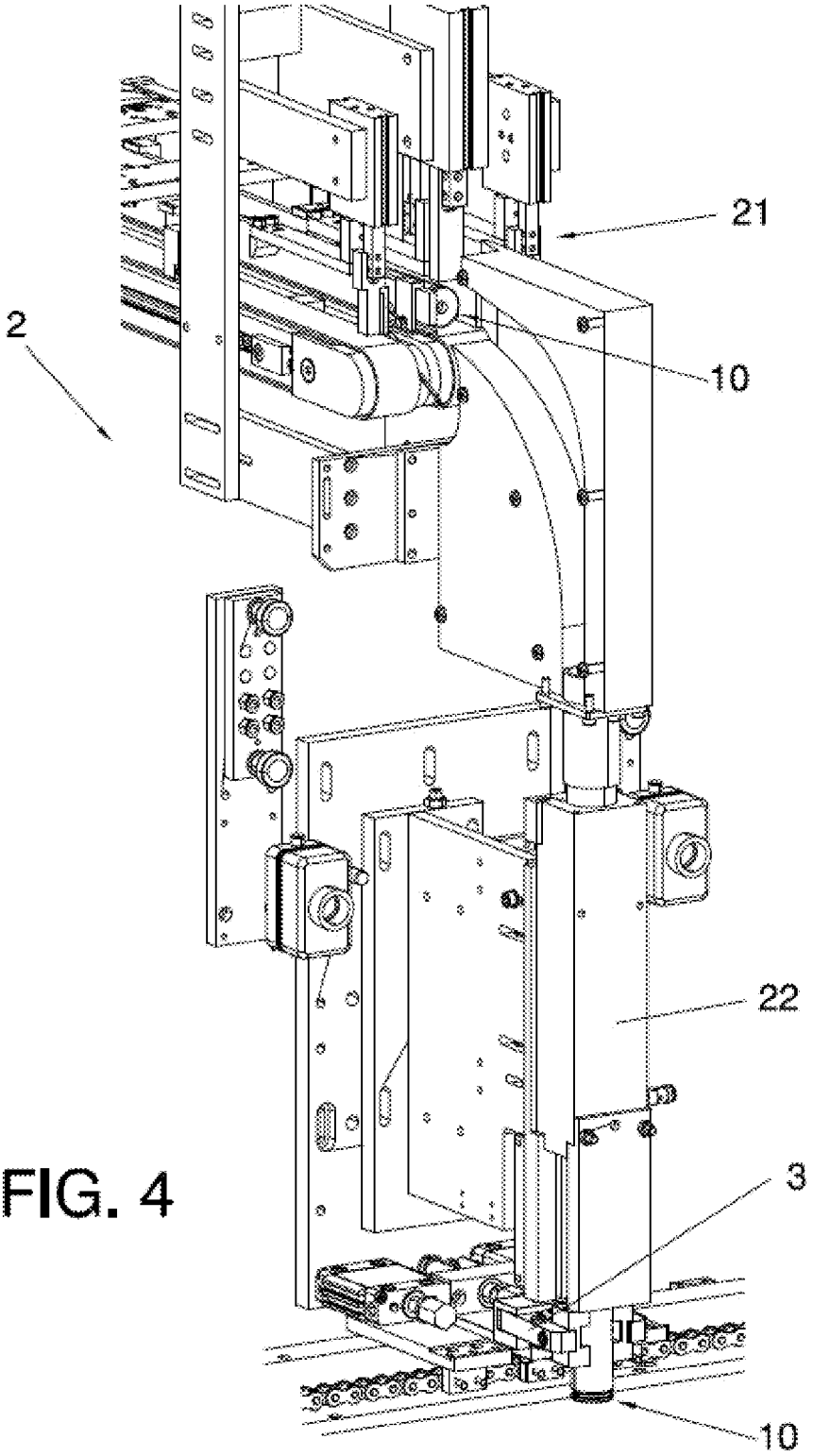
FIG. 4 shows a general diagram of an intake system according to an embodiment of the invention

FIG. 4 shows the operation of a cartridge intake system (2) according to a preferred embodiment. This system comprises an oriented cartridge accumulation and dosing device (21) and a sluice mechanism (22). It also comprises a photoelectric detection sensor.

The cartridges (10) enter the disarming system through the oriented cartridge accumulation and dosing device (21). Oriented cartridges are accumulated in this device to enable stocking the disarming system, absorbing the possible variations in the rate of handling cartridges (10) that occurred before they entered.

Then there is the sluice mechanism (22) which allows the cartridges (10) to pass one by one, at the request of the following step. The oriented cartridge accumulation and dosing device (21) also acts as a cartridge chamber. The cartridge (10) coming out of the sluice (22) falls between the grips of a clamp (3) which were previously opened by a pneumatic cylinder. Then, when the photoelectric detection sensor detects that the cartridge (10) is placed in the clamp (3), the clamp is closed and moves forward to the next station.

Figure 5:
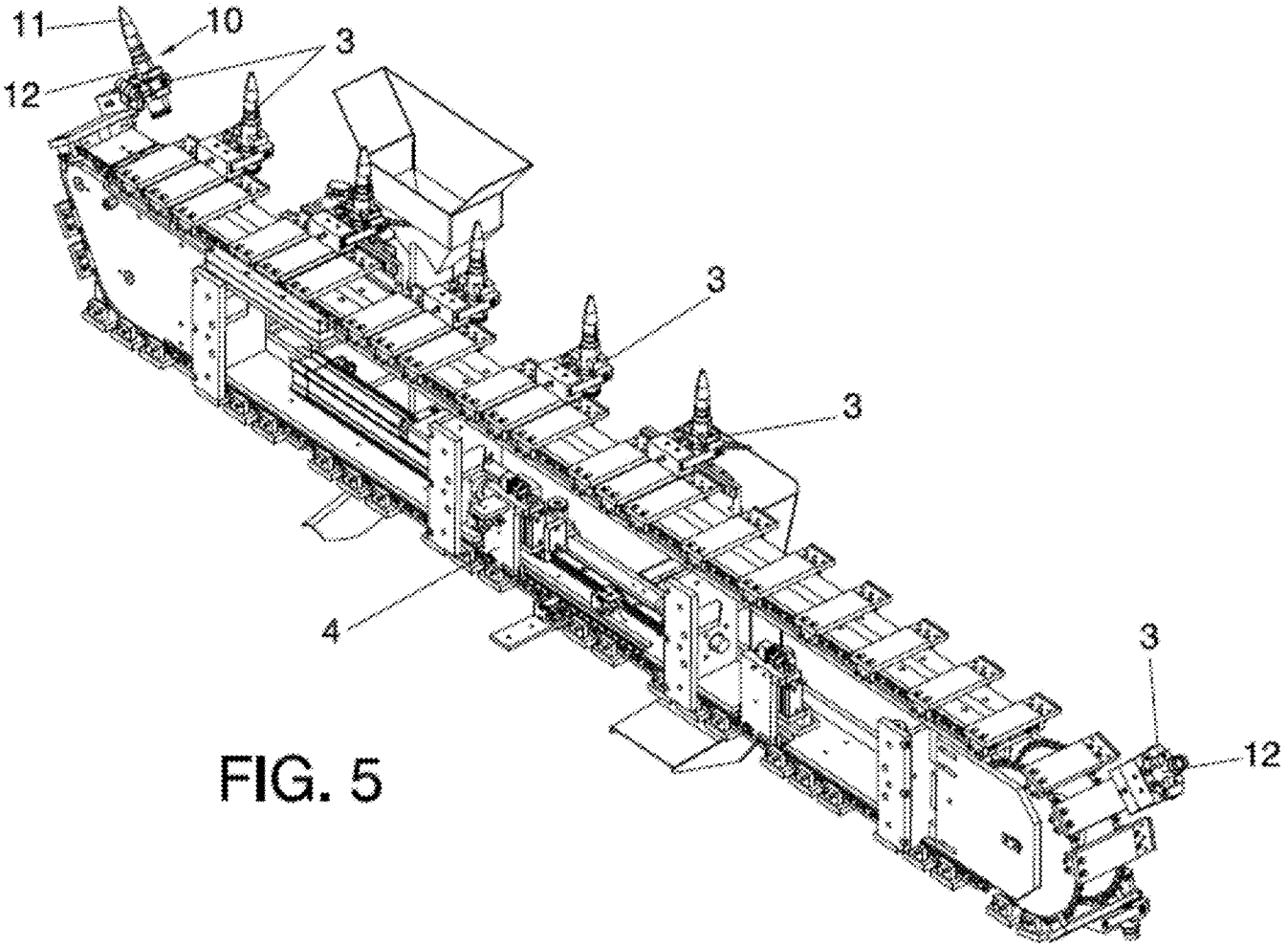
FIG. 5 shows a general diagram of a circulating clamp system according to an embodiment of the invention

FIG. 5 shows the structure of the set of circulating clamps (3) which transfers the cartridges (10) through the disarming system. Said set of circulating clamps (3) comprises a plurality of clamps assembled on forward movement means (4) that take them through all the stations of the disarming system. In each step of these forward movement means (4) all the clamps are moved the necessary distance to take each cartridge (10) to the next station. In a particular embodiment, these forward movement means (4) comprise three pneumatic cylinders: the first one is responsible for catching the transport means, the second one moves the first one to the next station and the third one holds the transport means while the second one returns to its initial position to carry out the next movement. For each step the forward movement means (4) move forwards, the entire circulating clamp system (3) moves forward one step. There will be steps in which one of the disarming steps is carried out and intermediate steps in which no action is performed. These clamps will hold the ammunition cartridges (10) and take them through each of the steps.

After the intake system there is arranged the dismantling system (5), previously described in FIG. 1, in which the cartridges are separated into their main components.

As seen in FIG. 3, the movement of the upper support (52) and/or of the bullet extraction head (53) is coordinated with the forward movement means (4) of the circulating clamps (3), such that a rotation of the eccentric connecting rod-wheel system (not shown) (which corresponds to an upwards and downwards movement of the upper support (52) and of the bullet extraction head (53)) corresponds to a forward movement of the circulating clamp system (3).

Once the bullet (11) has been extracted from the cartridge (10) in the dismantling system (5), the casing (12) follows the path while being held by the circulating clamps (3).

Preferably, after extracting the bullet (11), it is verified that the bullet (11) has actually been extracted by means of a detection rod located at the outlet of the dismantling system (5). Once this check is made, the circulating clamps (3) continue their path, inverting their orientation such that once the bullet (11) is extracted from the casing (12), when the orientation is changed by the circulating clamps (3), the content of said casing (12) falls due to gravity into the extracted powder collection hoppers (93). The powder collection hoppers (93) preferably comprise suction means for suctioning the collected powder.

In a subsequent step of the exemplified embodiment it is verified that the powder was correctly extracted from the casing (12) by means of one or several verification rods located after the extracted powder collection hoppers (93). The verification rods are introduced in the casing (12) and if they make it through the entire path without encountering any resistance, they would confirm that the powder has been emptied out of the casing (12). After checking the extraction of the bullet (11) and the emptying of the casing (12), the circulating clamps (3) continue along their path to the next step, which in the example shown consists of striking the empty casings (12), detonating the primer. The primer is therefore rendered useless, and the remaining powder is coincidentally consumed as well.

Figure 6:
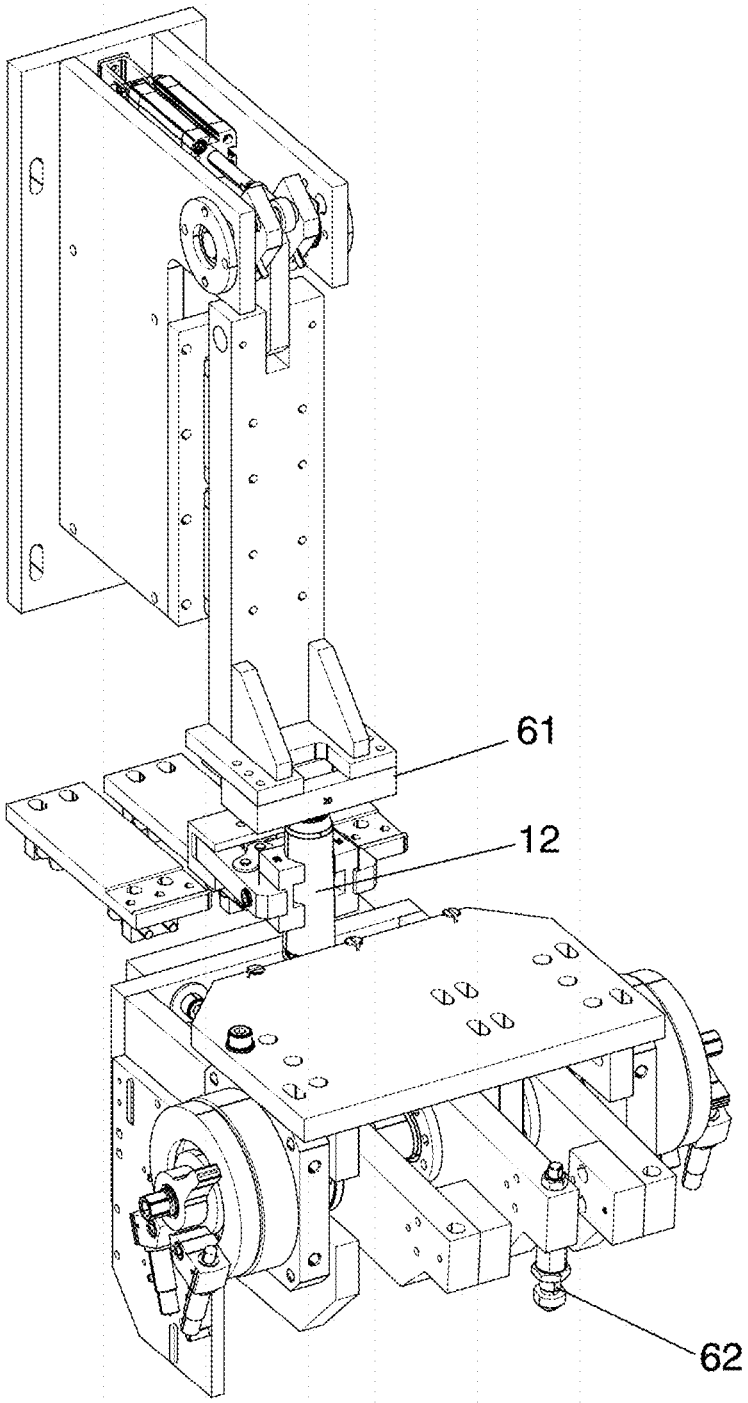
FIG. 6 shows a general diagram of a striking system according to an embodiment of the invention

FIG. 6 shows the configuration of the striking system (6). At least the following elements are distinguished in this system:

- a horizontally arranged casing stop plate (61) acting as an upper stop of the casing (12) to prevent it from moving when being struck,
- at least one striker (62) which is moved towards the primer of the casing (12) to strike it and cause its detonation.

Both the casing stop plate (61) and the at least one striker (62) are interchangeable and adjustable elements, depending on the gauge of the ammunition cartridges to be processed.

In this striking step, the casing (12) is held on the casing seat, while the striker (62) hits the primer of the casing (12), causing the detonation of the powder residues that may be left inside it.

The striking system (6) also preferably comprises a device for suctioning and filtering the gases resulting from the striking.

The struck casings (12) are subsequently crushed. The crushing system (7) comprises jaws operated by pneumatic cylinders. There are crushing blades at the end of the jaws such that when the jaws close, the crushing blades crush the casing. In a particular embodiment, the crushing blades include a V-shaped tongue and grooving to perforate as well as to crush the casing.

The last step consists of ejecting the casings once they are struck and crushed through the empty casing outlet hopper. The ejection system also includes a check ejector which verifies that the casing was correctly ejected. The check ejector tries to travel along its path. If the casing had not been ejected, the check ejector could unjam it. If it could not, it would detect this situation and trigger an alarm signal so that the operator can manually unjam it.

The invention claimed is:

1. A dismantling system (5) for separating ammunition cartridges (10) comprising a casing (12), a bullet (11) and powder, the dismantling system further comprising:

- an extraction head (53) for extracting the bullet (11) from the casing (12), and
- retaining elements (52) for retaining the casing (12) in an extraction position while extracting the bullet (11), the retaining elements comprising:
  - an upper support (52), suitable for resting on a widening of the cross section of the casing (12), preventing the casing (12) from moving in the extraction direction of the bullet (11), the upper support (52) being connected to motor elements for moving the upper support (52) linearly in a direction to bring the upper support (52) closer to and further from the extraction position,
  - motor elements for moving the extraction head (53) in a direction to bring the extraction head (53) closer to and further from the extraction position of the casing (12),
- wherein the system further comprises:
  - a flywheel and a cam follower, wherein the extraction head (53) is attached to the flywheel via a connecting rod eccentrically attached to the flywheel, which corresponds to an upwards and downwards movement of the upper support (52) and of the extraction head (53), and wherein the upper support (52) is attached to the cam follower that runs through a groove of the flywheel, in a way that the upper support (52) is in a lower position prior to the extraction head (53) coming into contact with the bullet (11), and starting movement upwards again after the extraction head (53) has extracted the bullet (11).

2. The dismantling system (5) according to claim 1, wherein the retaining elements (52) comprise at least one flange suitable for holding the casing (12) via driving said flange on a base of the casing (12).

3. The dismantling system (5) according to claim 1, wherein the extraction head comprises at least two dogs (532) suitable for being driven on the bullet (11) of the cartridge (10) and arranged in the extraction head (53) for peripherally surrounding at least part of the bullet (11).

4. The dismantling system (5) according to claim 3, wherein each dog (532) comprises a pivoting element, the pivoting element comprising a pivoting point on which it can rotate and at least one claw projecting from one end of the pivoting element and which is suitable for being driven on a bullet (11).

5. The dismantling system (5) according to claim 3, additionally comprising a spring (533) connected with the pivoting element of the dog (532) such that a rotation of the pivoting element with respect to a position in which the dog (532) and spring (533) assembly is balanced has to overcome a recovery force exerted by the spring (533).

6. A disarming system for disarming ammunition cartridges (10), comprising the dismantling system according to claim 1.

7. The disarming system according to claim 6, comprising:

a plurality of circulating clamps (3), each clamp being suitable for holding a cartridge (10), and forward movement elements (4) of the circulating clamps (3) suitable for moving the circulating clamps (3) through the disarming system.

8. The disarming system according to claim 6, additionally comprising at least one of:

a striking system (6) for detonating primers of empty casings (12), the striking system hitting the primer of the casing (12) causing a detonation of any powder residues that may be left inside, a crushing system (7) for crushing struck casings (12), an ejection system (8) for ejecting the casings (12), at least one verification element which informs in the event that the dismantling system (5) and/or in the ejection system have not been correctly operated, a plurality of outlet ramps for receiving components of cartridge (10) individually, and a plurality of outlet hoppers (91, 92, 93) for collecting the components of the cartridge (10).

9. The disarming system for disarming the components of an ammunition cartridge (10) according to claim 6, characterized in that at least one of the elements of the disarming system is interchangeable for adapting its operation to different gauges of ammunition cartridges (10).

10. A method for separating the components of an ammunition cartridge (10) using a dismantling system according to claim 1, wherein the method comprises the following steps:

a) holding the casing (12) of the cartridge (10) using retaining elements (52), b) extracting the bullet (11) from the cartridge (10), and c) inverting the orientation of the cartridge (10), causing the explosive material to be emptied from its interior, wherein the step a) is carried out before the extraction head (53) comes into contact with the bullet (11), the step b) is carried out via the extraction head (53), and after the step b) and before the step c), the retaining elements (52) are separated from the casing (12) after the extraction head (53) has already extracted the bullet (11) completely.

11. The method for separating the components of an ammunition cartridge (10) according to claim 10, where step b) for extracting the bullet (11) from the cartridge (10) comprises the following steps:

bringing an extraction head (53) closer to the cartridge (10), such that when the bullet (11) penetrates said bullet extraction head (53) it pushes dogs (532) comprised in said bullet extraction head (53), such that when pushed, said dogs (532) latch onto the bullet (11) of the cartridge (10), and moving the bullet extraction head (53) away, such that the dogs (532) pull the bullet (11) out of the casing (12) of the cartridge (10) in that movement.

12. The method for separating the components of an ammunition cartridge (10) according to claim 10, where step a) for holding the casing (12) of the cartridge (10) using retaining elements (52) comprises:

bringing the upper support (52) closer to the cartridge (10) arranged with a tip of the bullet (11) oriented towards said support, such that the support rests on a widening of a cross section of the casing (12) before the extraction head (53) comes into contact with the bullet (11).

* * * * *